US005216441A

United States Patent [19]

Isobe

[11] Patent Number: 5,216,441

[45] Date of Patent: Jun. 1, 1993

[54] THERMAL PRINTER AND EXPENDABLE CARTRIDGE EMPLOYED THEREIN

[75] Inventor: Minoru Isobe, Tokyo, Japan

[73] Assignee: Oki Electric Industry Co., Ltd., Tokyo, Japan

[21] Appl. No.: 748,464

[22] Filed: Aug. 22, 1991

[30] Foreign Application Priority Data

Aug. 31, 1990 [JP] Japan ..... 2-228192

[51] Int. Cl.[5] ..... B41J 2/325; B41J 32/00

[52] U.S. Cl. ..... 346/76 PH; 400/207; 400/208; 400/208.1

[58] Field of Search ..... 400/207, 208, 208.1; 346/76 PH

[56] References Cited

U.S. PATENT DOCUMENTS

| | | | |
|---|---|---|---|
| 4,647,234 | 3/1987 | Isobe | 346/76 PH |
| 4,696,590 | 9/1987 | Bierhoff et al. | 400/208 |
| 4,752,785 | 6/1988 | Isobe | 346/136 |
| 4,914,452 | 4/1990 | Fukawa | 400/207 |
| 5,005,998 | 4/1991 | Takanashi | 400/208 |

FOREIGN PATENT DOCUMENTS

| | | |
|---|---|---|
| 0315487 | 10/1989 | European Pat. Off. . |
| 63-242669 | 10/1988 | Japan . |

*Primary Examiner*—Benjamin R. Fuller
*Assistant Examiner*—Huan Tran
*Attorney, Agent, or Firm*—Spencer, Frank & Schneider

[57] ABSTRACT

A thermal printer has a body with a carrying mechanism for carrying a printing sheet, a driver for driving a narrow ink ribbon, a serial-type printing head for printing on the printing sheet and a controller for controlling the carrying mechanism, the driver and the printing head. An expendable cartridge is attached on the body for housing a narrow thermal ink ribbon and cut or rolled printing paper sheets in respective compartments thereof. The ribbon is exposed partially and is able to be wound up and let out. In this way, when the cartridge is attached on the body, the carrying mechanism confronts the printing sheet, the printing head confronts the exposed portion of the ink ribbon, and is engaged with the ink ribbon driver.

7 Claims, 11 Drawing Sheets

THERMAL PRINTER AND EXPENDABLE CARTRIDGE EMPLOYED THEREIN

BACKGROUND OF THE INVENTION

1. Field of the Invention

The present invention relates to a small-sized thermal printer which employs a thermal ink ribbon and is capable of carrying out mainly a color printing on a printing sheet by use of a heating element.

2. Description of the Prior Art

Conventionally, thermal printers carry out a printing on a printing sheet by heating a heat fusible ink ribbon or a heat sublimate ink ribbon with a heating element. Under the present, technique, the thermal printer of this type is believed to be the smallest and able to be manufactured with low cost as a color printer, particularly a full, color printer as disclosed in U.S. Pat. No. 4,752,785. In order to realize the small-sized thermal printers, a current trend is to house a printing sheet in a cassette or to house an ink ribbon in a cartridge.

The fact that the thermal printer can be made small-sized may mean that a portable, personal thermal color printer will appeal to many potential users. An urgent problem to be solved now is to provide for a printer of this type that can be operated by users with ease and safety, and particularly, an arrangement of a printing sheet and thermal ink ribbon as expendables to be replaced by new ones with ease and safety.

SUMMARY OF THE INVENTION

Accordingly, it is an object of the present invention to provide a thermal printer and an expendable cartridge replaceable by new ones with ease and safety without preventing the miniaturization of the thermal printer while keeping the thermal ink ribbon running safely.

To achieve the above objects, the thermal printer according to the present invention comprises a thermal printer body having carrying means for carrying printing sheets, driving means for driving an ink ribbon, printing means for carrying out printing on the printing sheet and control means for controlling the carrying means, the driving means and the printing means and an expendable cartridge attached on the body for housing a long thermal ink ribbon therein and cut or rolled printing paper sheets, the printing ribbon being exposed partially and being able to be wound up and let out; whereby when the cartridge is attached on the body, the carrying means confronts the printing sheets, the printing means confronts the exposed portion of the ink ribbon, and is engaged with the ink ribbon driving means.

The expendable cartridge according to the present invention comprises a printing sheet cartridge for housing cut print sheets or rolled print sheets therein, and an ink ribbon cartridge incorporated with the printing sheet cartridge for housing a long ink ribbon having one or plural colors therein so as to be able to be wound or unwound from spools protruding therefrom.

DETAILED DESCRIPTION OF THE PREFERRED EMBODIMENTS

First Embodiment(FIGS. 1 to 9)

Figure 1:
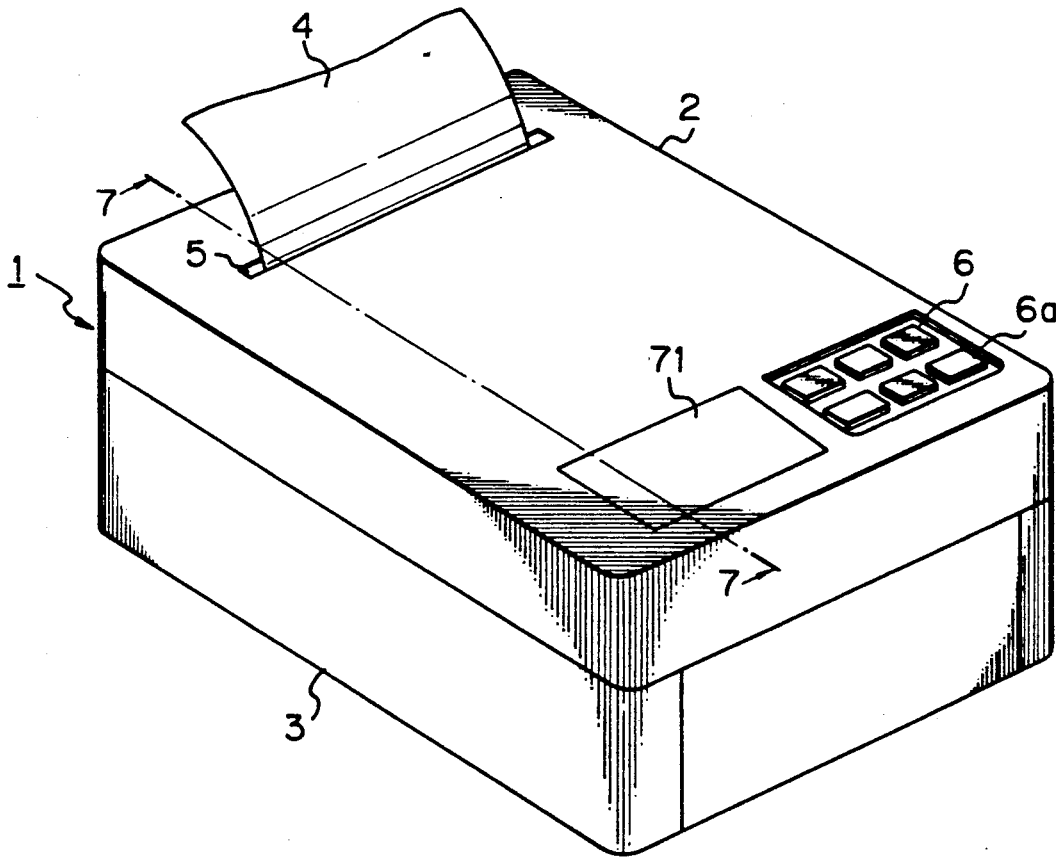
FIG. 1 is a perspective view of a thermal printer according to a first embodiment of the present invention.

A thermal printer and an expendable cartridge employed therein according to a first embodiment will be described with reference to FIGS. 1 to 9.

A thermal printer 1 comprises an upper unit 2 and a lower unit 3 as a whole. The upper unit 2 has a discharge slit 5 through which a printing sheet 4 is discharged and an operation portion 6 and a display 71 disposed opposite to the discharge slit 5 on an upper surface thereof. The operation portion 6 is composed of a plurality of switches such as a printing start switch 6*a*.

Figure 2:
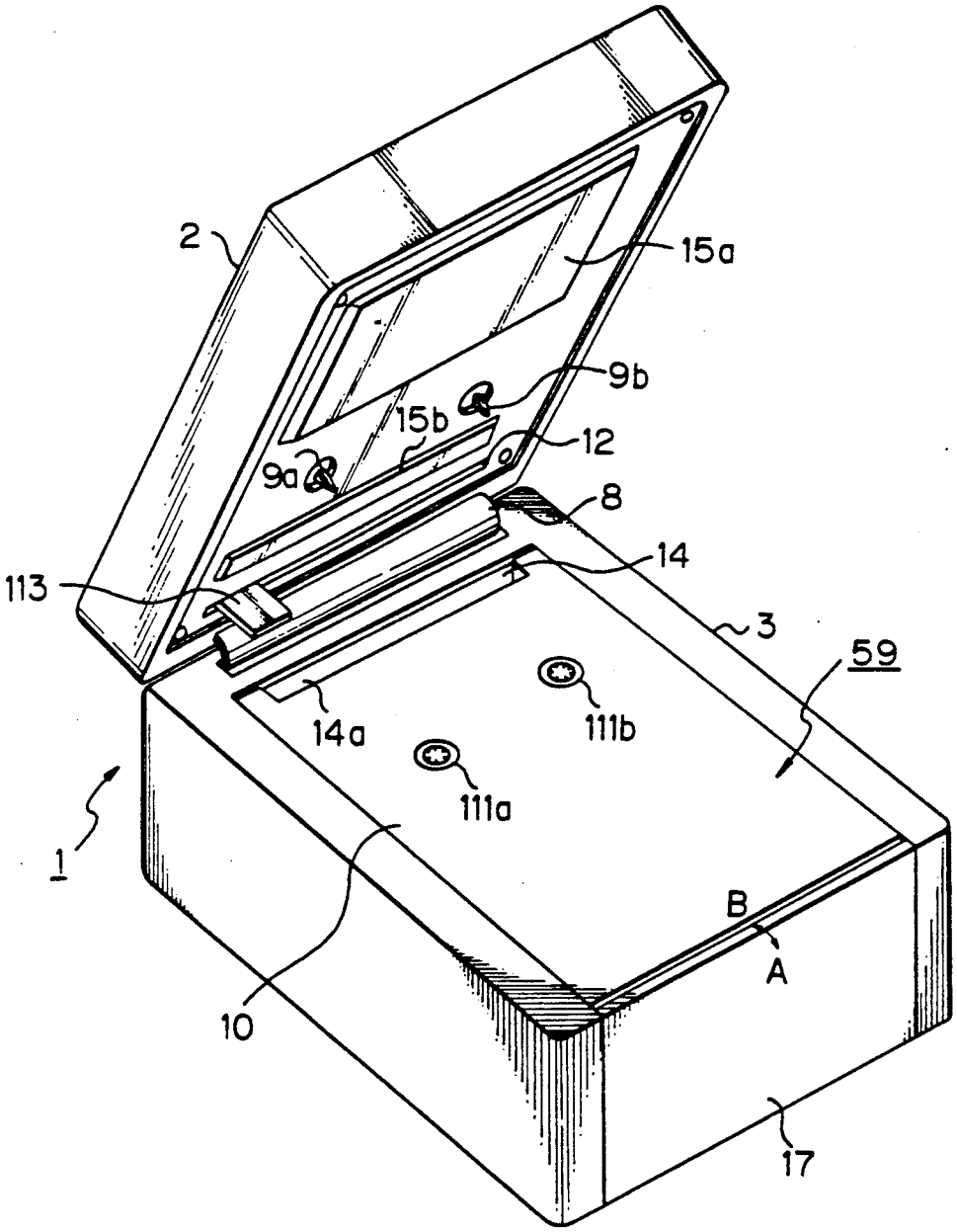
FIG. 2 is a perspective view of the thermal printer in FIG. 1 in which an upper unit is opened.

In FIG. 2, the upper unit 2 is pivotally attached to the lower unit 3 by a hinge 8 so as to be openable. A winding shaft 9*a* and a guide shaft 9*b* protrude from a lower surface of the upper unit 2 for driving a long narrow thermal printing ink ribbon, described later. The winding shaft 9*a* and the guide shaft 9*b* are held by ribbon spools 111*a* and 111*b* of an ink ribbon cartridge 10 when the upper unit 2 is closed. The winding shaft 9*a* is rotatably driven by a motor, described later.

The upper unit, 2 has an opening 12 at the lower surface thereof extending along a width direction thereof. A thermal head 113 protrudes downward from the opening 12. The thermal head 113 is, as described later, movable reciprocally within the opening 12 in the width direction of the upper unit 2. The thermal head 113 is positioned opposite to an exposed part 14*a* of the ink ribbon 14 which is exposed from the ink ribbon cartridge 10 when the upper unit 2 is closed. The thermal head 113 may be accommodated in the upper unit 2 when it is not operated.

The upper unit 2 has convex portions 15*a* and 15*b* at the lower surface thereof for pressing the ink ribbon cartridge 10 in order to prevent the ink ribbon cartridge 10 from displacing from a normal position thereof.

Figure 3:
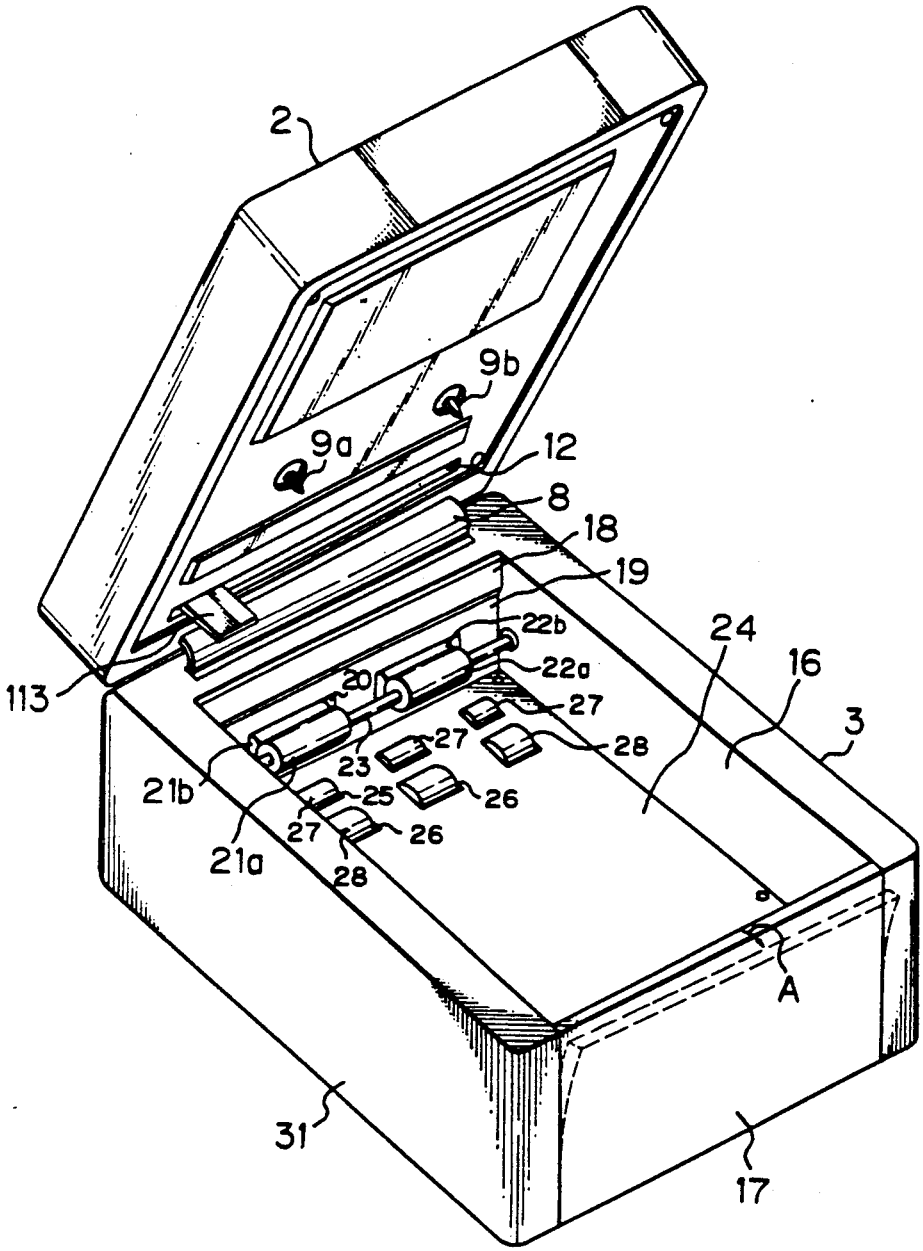
FIG. 3 is a perspective view of the thermal printer in FIG. 1 in which a cartridge is detached therefrom.

The lower unit 3 has the ink ribbon cartridge 10 mounted on a mounting portion 16 in FIG. 3. The ink ribbon cartridge 10 has a size substantially same as the mounting portion 16 of the lower unit 3 and is put in the mounting portion 16 in the manner that the exposed portion 14*a* of the ink ribbon 14 is positioned at an innermost portion of the lower unit 3. The lower unit 3 has a side wall 17 at the portion opposite to the innermost portion. The side wall 17 is flexible in the direction of the arrows A-B so as to facilitate to mount the ink ribbon cartridge 10 on the lower unit 3 and dismount the ink ribbon cartridge 10 from the lower unit 3.

FIG. 3 shows a state where the ink ribbon cartridge 10 and the printing sheet cartridge 52 are dismounted from the mounting portion 16 of the lower unit 3. The mounting portion 16 will be described hereafter.

A platen 18 is formed at an innermost side portion of the mounting portion 16. The platen 18 is positioned to confront the exposed portion 14*a* of the ink ribbon 14 when the ink ribbon cartridge 10 is mounted. Two pairs of carrying rollers 21*a*, 21*b* and 22*a*, 22*b* are rotatably disposed in the mounting portion 16. The carrying rollers 21*a* and 22*a* are attached to a shaft 23 while the carrying rollers 21*b* and 22*b* are attached to another shaft, not shown. A plurality of openings 25 and 26 are formed on a bottom surface 24 of the mounting portion 16. A plurality of rollers 27 are exposed from the openings 25 while a plurality of feeding rollers 28 are exposed from the openings 26. The feeding rollers 28 are rollers for feeding the printing sheet from the mounted printing sheet cartridge while the rollers 27 are rollers for separating the printing sheets.

Figure 4:
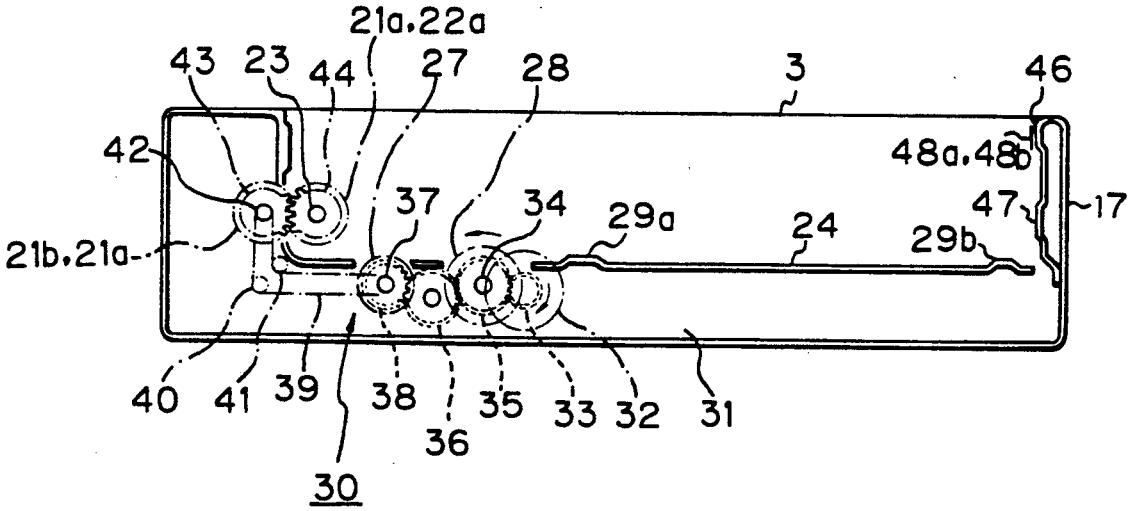
FIG. 4 is a view showing a carrying mechanism in FIG. 1.

A carrying mechanism 30 according to the first embodiment of the present invention is mounted on the lower unit 3 as shown in FIG. 4. A carrying motor 32 is disposed at the left side 31 of the lower unit 3 and has a shaft on which a gear 33 is attached. The gears' 33 meshes with gear 35 attached to a shaft 34 on which the feeding rollers 28 are attached. The gear 35 meshes with an idle gear 36 which meshes with a gear 38 attached to a shaft 37. The rollers 27 are attached to the shaft 37. A belt 39 is wound around the shaft 37 and also wound around a shaft 42 on which the carrying rollers 21*b* and 22*b* are attached by way of pulleys 40 and 41. A gear 43 is attached on the shaft 42 and meshes with a gear 44 attached on the shaft 23.

With the arrangement of the carrying mechanism 30, if the feeding motor 32 is rotated clockwise, the feeding rollers 28 are rotated counterclockwise and the rollers 27 are rotated counterclockwise and the carrying rollers 21*b* and 22*b* are rotated counterclockwise and the feeding rollers 21*a*, 22*a* are rotated clockwise.

In FIG. 4, a convex portion 46 is formed at the inner upper portion of the side wall 17 of the lower unit 3 for holding the ink ribbon cartridge with assuarance. Conductive plates 48*a* and 48*b* are attached to right and left sides of the convex portion 46 for serving to supply a current from a power supply in the ink ribbon cartridge to necessary portions of the thermal printer. A convex portion 47 is formed at the inner lower portion of the side wall 17 for holding the printing sheet cartridge 52 with assuarance together with convex portions 29*a* and 29*b* formed on the bottom surface 24 of the mounting portion 16 and reducing friction between the side wall 17 and the printing sheet cartridge 52.

The ink ribbon cartridge 10 and the printing sheet cartridge 52 will be described more in detail with reference to FIGS. 5 to 6.

Figure 5:
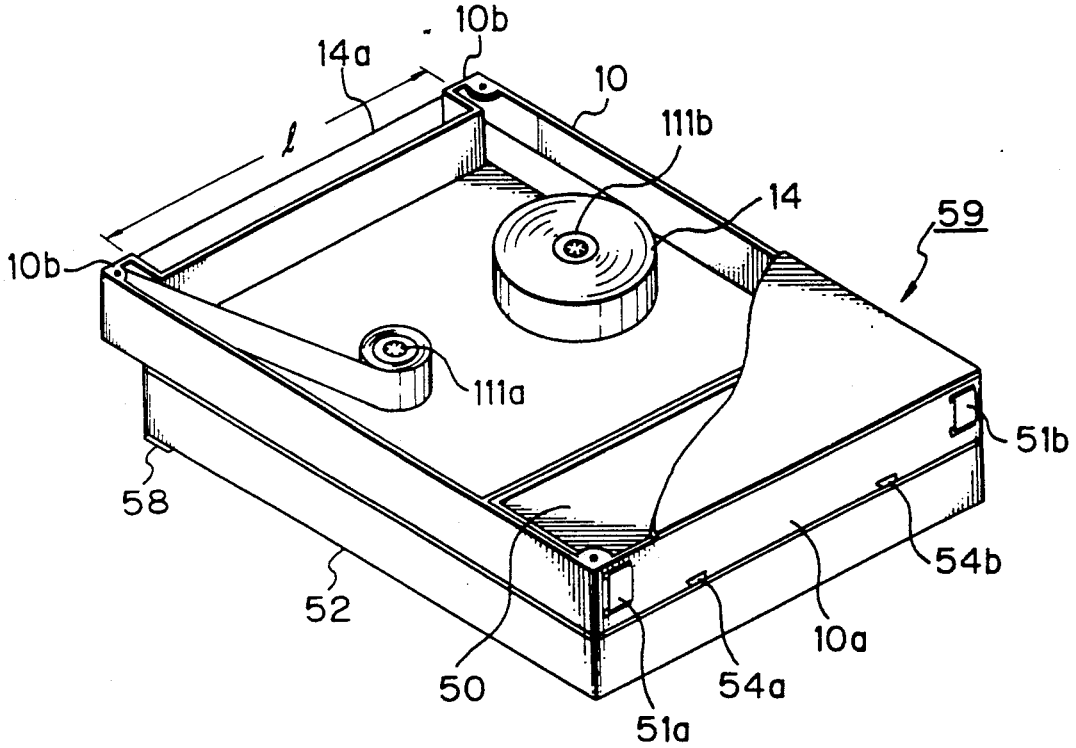
FIG. 5 is a partly cut away perspective view showing an ink ribbon cartridge and a printing sheet cartridge.
Figure 6:
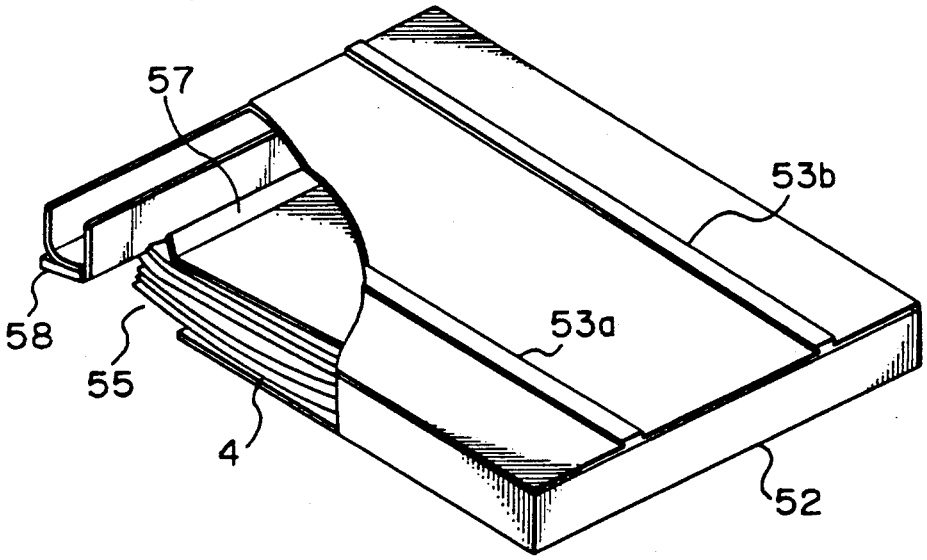
FIG. 6 is a partly cut away perspective view showing the printing sheet cartridge.

In FIG. 5, the ink ribbon cartridge 10 houses the long ink ribbon 14 and a battery 50 therein. The ink ribbon 14 is used for a color printing and has three colors, i.e. yellow, cyan and magenta which are arranged in this order in the longitudinal direction thereof, not shown. One color extends to the length which is the same as the length of the exposed portion 14*a*.

The battery 50 is a power supply for suppling a direct current to the necessary portions of the upper and lower units 2 and 3 and has both electrodes connected to conductive parts 51*a* and 51*b* disposed at both ends of the side wall 10*a* of the ink ribbon cartridge 10. These conductive parts 51*a* and 51*b* are connected to the conductive plates 48*a* and 48*b* when the ink ribbon cartridge is mounted on the mounting portion 16.

The printing sheet cartridge 52 stacks cut sheets therein and has a boxlike shape same as the ink ribbon cartridge 10 but short in length at the top end thereof compared with the ink ribbon cartridge 10. The printing sheet cartridge 52 has guide rails 53*a* and 53*b* which ar inclined at the upper surfaces thereof as illustrated in FIG. 6. When the guide rails 53*a* and 53*b* are engaged in grooves 54*a* and 54*b* formed in the lower portion of the ink ribbon cartridge 10 (FIG. 5), both the ink ribbon cartridge 10 and the printing sheet cartridge 52 constitute an expendable cartridge 59. In FIG. 6, the printing sheet 4 positioned lowest in the stack of printing sheets housed in the printing sheet cartridge 52 is fed from an opening 55 which is defined at the lower surface of the printing sheet cartridge 52. A leaf spring 57 is attached to an inner upper surface of the printing sheet cartridge 52 for pressing the printing sheets 4 toward the opening 55. A high frictional member 58 such as a rubber is attached to a tip end bottom portion of the printing sheet cartridge 52 and extends in the entire width direction of the cartridge 52.

Figure 7:
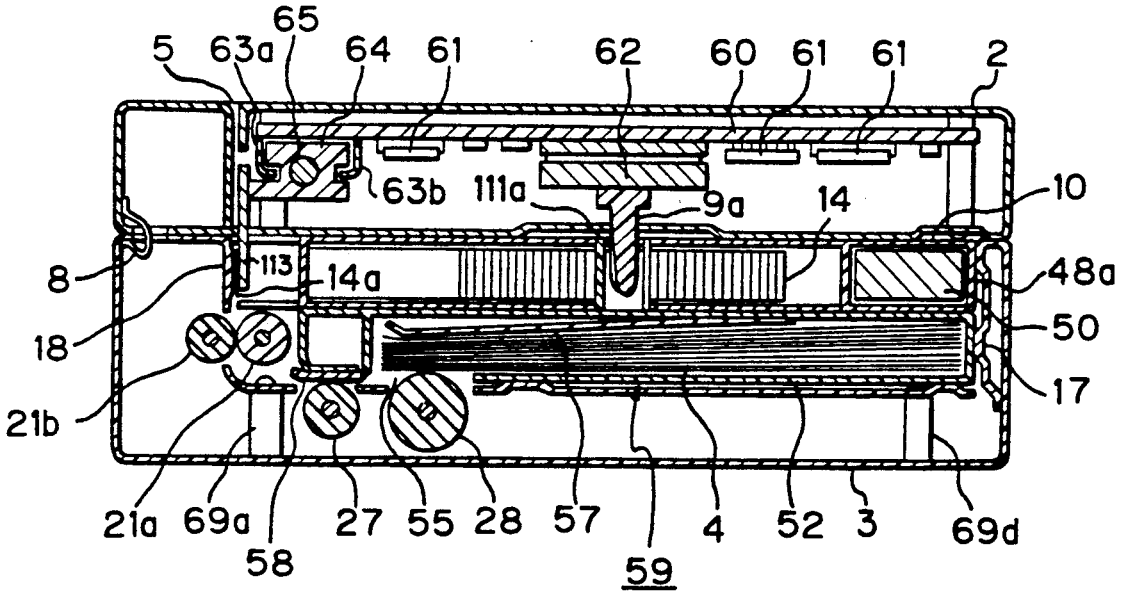
FIG. 7 is a cross sectional view taken along VII—VII in FIG. 1.

The inside of the upper unit 2 and the mounting state of the expendable cartridge 59 will be described more in detail with reference to FIG. 7.

In the same figure, a printed circuit substrate 60 is disposed inside the upper unit 2 and has a variety of circuit elements 61 necessary for controlling the thermal printer and a control portion, described later, which are mounted on the printed circuit substrate. A flat motor 62 is attached to the substrate 60 and has the winding shaft 9*a* at a rotary shaft thereof. Guide rails 63*a* and 63*b* are attached to the substrate 60 and has a carriage 64 to which a thermal head 113 is attached. The carriage 64 is slidable in the width direction of the upper unit 2. A screw shaft 65 is engaged with a central portion of the carriage 64 which moves perpendicular to the printing sheet 4 when the screw shaft 65 is rotated. The screw shaft 65 can be rotated by a motor, described later.

When the expendable cartridge 59 composed of the printing sheet cartridge 52 and the ink ribbon cartridge 10 is mounted on the lower unit 3, the printing sheet 4 positioned lowest in the printing sheet cartridge 52 is pressed against the feeding rollers 28 at the opening 55. The high frictional member 58 is brought into contact with the rollers 27. The exposed portion 14*a* of the ink ribbon 14 confronts the platen 18 of the lower unit 3.

When the upper unit 2 is moved downward to close the lower unit 3 on which the expendable cartridge 59 is mounted, the winding shaft 9*a* and the guide shaft 9*b* are held by the ribbon spools 111*a* and 111*b* and the thermal head 113 is brought into contact with the exposed portion 14*a* of the ink ribbon 14.

Figure 8:
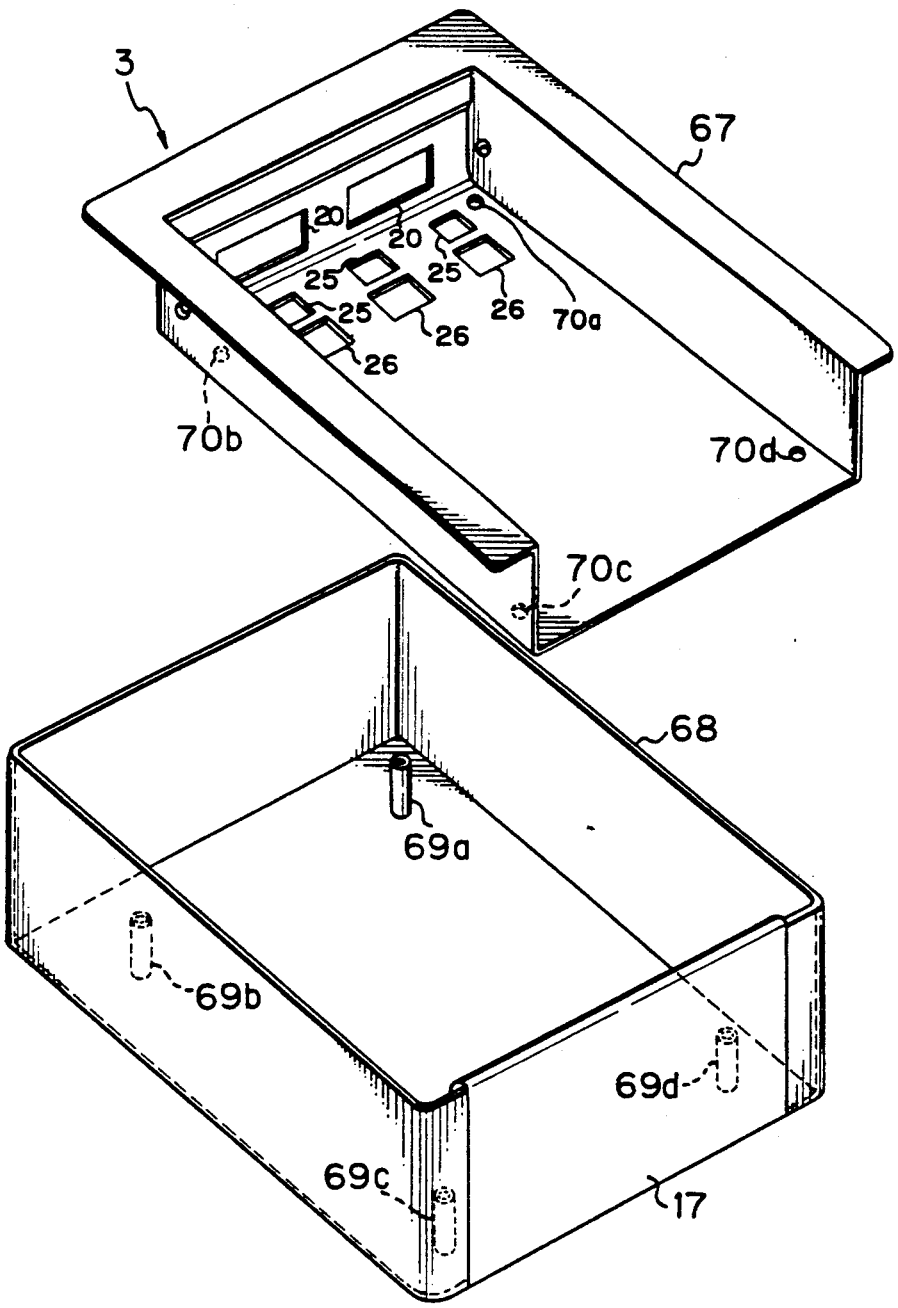
FIG. 8 is an exploded perspective view showing a lower unit in FIG. 1.

In FIG. 8, the lower unit 3 comprises an inner member 67 and an outer member 68. The carrying mechanism 30 (FIG. 4) is disposed between the inner member 67 and the outer member 68. The outer member 68 has studs 69*a*, 69*b*, 69*c* and 69*d* respectively. The inner member 67 is supported with the studs 69*a*, 69*b*, 69*c* and 69*d*, and the the inner member and the outer member are fastened to each other with screw holes 70*a*, 70*b*, 70*c* and 70*d*.

The control portion 81 for controlling the thermal printer will be described more in detail with reference to FIG. 9.

The control portion 81 controls the entire operation of the thermal printer. The control portion 81 comprises a CPU (Central Processing Unit) 82 for controlling the operation of the thermal printer, a ROM (Read Only Memory) 83 for storing an execution program of the CPU 82, a RAM (Random Access Memory) 84 for storing the printing data temporarily, input and output-(I/O) ports 85, 86, 87 and a motor driver 88 which is driven by the I/O port 87. These elements are connected with one another by a common bus 90. The I/O port 85 is connected to the operation portion 6 and receives a signal supplied by the operation portion 6. The I/O port 86 is connected to the thermal head 113 for supplying the printing data to the thermal head 113. The motor driver 88 drives a carriage motor 89, the flat motor 62 and the carrying motor 32 illustrated in FIG. 4, and the carriage motor 89 rotates the screw shaft 65 as illustrated in FIG. 7 to thereby move the carriage 64. The control portion 81 is mounted on the substrate 60 as illustrated in FIG. 7.

An operation of the thermal printer according to the first embodiment of the present invention will be described hereafter.

As illustrated in FIG. 5, the printing sheet cartridge 52 is incorporated with the ink ribbon cartridge 10 by engaging the guide rails 53*a* and 53*b* of the printing sheet cartridge 52 with the grooves 54*a* and 54*b* of the ink ribbon cartridge 10 so as to constitute the expendable cartridge 59. Then, the upper unit 2 is opened as illustrated in FIG. 3 and the expendable cartridge 59 is mounted on the mounting portion 16 of the lower unit 3 in the manner that the printing sheet cartridge 52 is disposed under the ink ribbon cartridge 10. At this time, the side wall 17 is slightly bent in the direction of the arrow A as illustrated in broken lines to facilitate the mounting of the expendable cartridge 59. FIG. 2 is the view showing a state where the expendable cartridge 59 is mounted on the lower unit 3. At this state, the side wall 17 presses the ink ribbon cartridge 10 and the printing sheet cartridge 52 toward the platen 18 so that the tip end both sides 10*b* of the ink ribbon cartridge are brought into contact with the platen 18, whereby the ink ribbon cartridge 10 is positioned and held by the lower unit 3 with assurance. At this state, as illustrated in FIG. 7, the printing sheet 4 positioned lowest in the printing sheet cartridge 52 is pressed against the feeding rollers 28 by a pressing force of the leaf spring 57. The high frictional member 58 is brought into contact with the rollers 27. The exposed portion 14*a* of the ink ribbon 14 in the ink ribbon cartridge 10 is positioned opposite to platen 18. The conductive parts 51*a* and 51*b* attached to the side wall 10*a* of the cartridge 10 contact the conductive plates 48*a* and 48*b* of the side wall 17. The conductive plates 48*a* and 48*b* are connected to the necessary portions of the upper unit 2 and the lower unit 3 by some means, not shown.

Successively, the upper unit 2 is closed. When the upper unit 2 is closed, as illustrated in FIG. 7, the thermal head 113 is brought into contact with the exposed portion 14*a* of the ink ribbon 14 and the winding shaft 9*a* attached to the flat motor 62 is held by the spool 111*a* disposed in the ribbon cartridge 10 and the guide shaft 9*b* is held by the ribbon spool 111*b*. At this state, the printing operation can be started.

Figure 9:
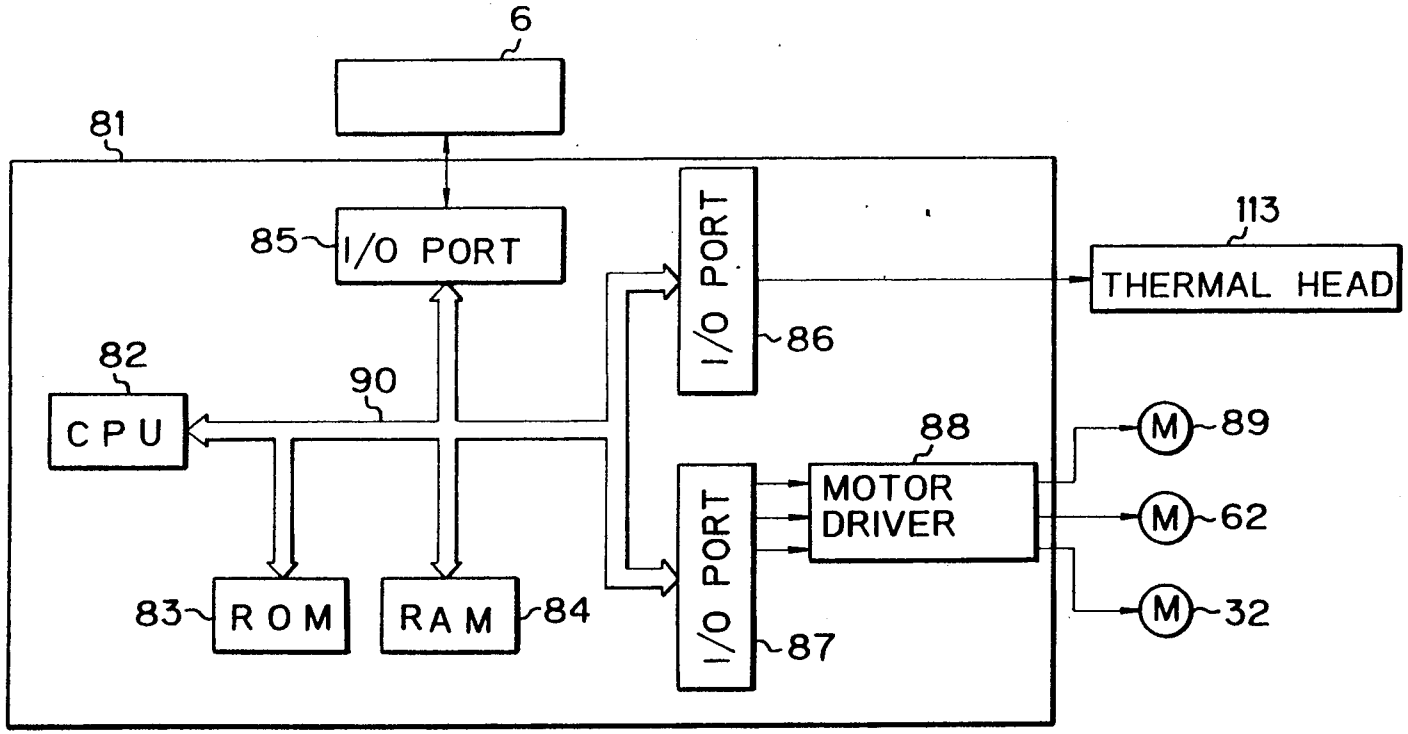
FIG. 9 is a block diagram showing a control portion in FIG. 1.

If the printing start switch 6*a* of the operation portion 6 as illustrated in FIG. 1 is pressed, the printing start signal is supplied to the control portion 81 as illustrated in FIG. 9. The CPU 82 supplies an instruction to the motor driver 88 to rotate each motor 89, 62, 32, by way of the I/O port 87. When the carrying motor 32 is rotated clockwise in FIG. 4, the feeding rollers 28, the rollers 27 and the carrying rollers 21 and 22 are respectively rotated. In FIG. 4, one printing sheet is fed by the counterclockwise rotation of the feeding rollers 28 and separated from the remaining printing sheets by the high frictional member 27 and thereafter carried by the carrying rollers 21 and 22 toward the platen 18.

If the carridge motor 89 as illustrated in FIG. 9 is rotated, the screw shaft 65 is rotated to move the carridge 64 so that the thermal head 113 is returned to its original position. The rotation of the flat motor 62 renders the winding shaft 9*a* to rotate, thereby driving the ink ribbon 14 which involve the feeding of new ink ribbon. At this state, an initial preparation is completed. The control portion 81 drives the carridge motor 89 in response to the printing data to thereby rotate the screw shaft 65 for moving the thermal head 113 and heating the thermal head 113 whereby the thermal head 113 fuses the ink of the ribbon 14 and transfers the ink onto the printing sheet 4. Upon completion of the printing of one color in one line, the ink ribbon 14 is moved to the length corresponding to one color so that the different color is positioned before the platen 18. Thereafter, the thermal head 113 is heated in response to the printing data. These steps are repeated for carrying out the printing. The printing sheet is, after being subjected to the printing, discharged from the discharge slit 5.

The printing data may be supplied from the operation portion 6 or received by a host computer connected to the I/O port 15.

When the ink ribbon 14 was used and the new ink ribbon cartridge 10 is replaced by a new one, the upper unit 2 is moved upward and the side wall 17 is bent in the direction of the arrow A from the state as shown in FIG. 2, thereby taking out the ink ribbon cartridge 10. In case of replacement of the ink ribbon cartridge alone, the used ink ribbon cartridge 10 is detached from the printing sheet cartridge 10 and the new ink ribbon cartridge is incorporated with the printing sheet cartridge 52. The incorporated cartridges are mounted on the mounting portion 16 by bending the side wall 17.

The printing sheet cartridge is replaced by a new one. The replacement operation of the printing sheet cartridge 52 is made in the same way as the ink ribbon cartridge 10. In case of replacement of the battery 50, it is made by replacing the ink ribbon cartridge 10 by the new one.

As mentioned above, it is possible to replace both the cartridges by other ones or one of the cartridges is replaced by another one by one-step operation according to the present invention. It is possible to reduce the time of replacement if the ink ribbon 14, the printing sheet 4 and the battery 50 are consumed substantially at the same time. It is a matter of course to selectively incorporate the battery into one of the cartridges or into the thermal printer body.

Furthermore, it is also a matter of course that a single color ink ribbon can be employed although the thermal printer employed the color ink ribbon.

The upper unit and the lower unit may be reversed functionally.

According to the first embodiment, although the ink ribbon is held by the thermal head as the printing means and by the driving means for driving the ink ribbon at predetermined positions thereof by closing the upper unit after the expendable cartridge is mounted on the lower unit, the ink ribbon can be automatically held by the thermal head and by the driving means so that the openable structure, namely, the structure wherein the upper unit is opened or closed relative to the lower unit may be replaced by the insertable structure, namely, the structure wherein the expendable cartridge may insert into the thermal printer body. In the latter case, when the expendable cartridge is inserted from the opening into some position in the thermal printer body, a detector detects this insertion and produces a detected signal. Positioning means renders, upon reception of the detected signal, the expendable cartridge at a given position of the thermal printer body. When the expendable cartridge is positioned at the given position of the thermal printer body provided with the printing means and the ribbon driving means respectively disposed therein, the ink ribbon is held by the printing means and the ribbon driving means while the printing sheet confronts the printing sheet carrying means.

The expendable cartridge can be modified in various ways. For example, the ink ribbon cartridge and the printing sheet cartridge may be previously integrated with each other. In this case, the time and labor to incorporate both the ink ribbon cartridge and the printing sheet cartridge are omitted. In this case, it is preferable to set the length of the ink ribbon and the number of pieces of the printing sheets so that the ink ribbon and the printing sheets are consumed substantially at the same time.

Figure 10:
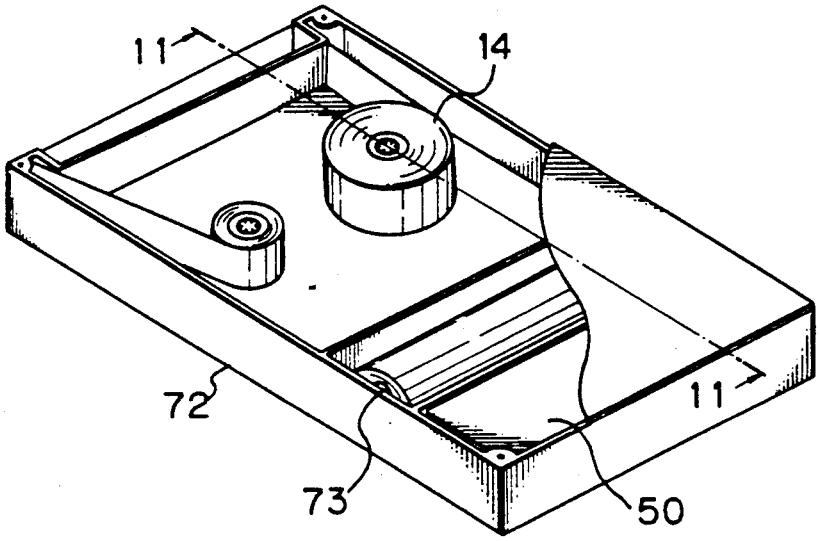
FIG. 10 is a partly cut away perspective view showing an expendable cartridge according to a second embodiment of the present invention.
Figure 11:
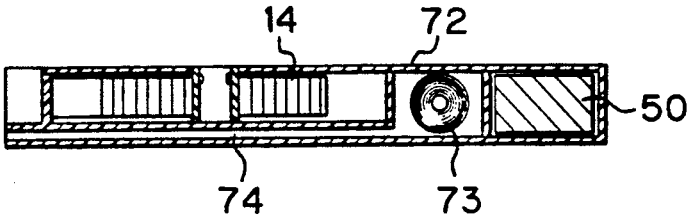
FIG. 11 is a cross sectional view taken along XI—XI in FIG. 10.

Second Embodiment (FIGS. 10 and 11)

An expendable cartridge according to a second embodiment will be described with reference to FIGS. 10 and 11.

The expendable cartridge 72 has three chambers housing the thermal ink ribbon 14, a rolled printing sheet 73 and the battery 50 respectively. The cartridge 72 has a travelling path 74 under the ink ribbon. The printing sheet 73 travels along the travelling path 74 and can be carried toward a printing portion, not shown.

With such an arrangement, it is possible to reduce the thickness of the expendable cartridge even if a rolled printing sheet is employed.

Figure 12:
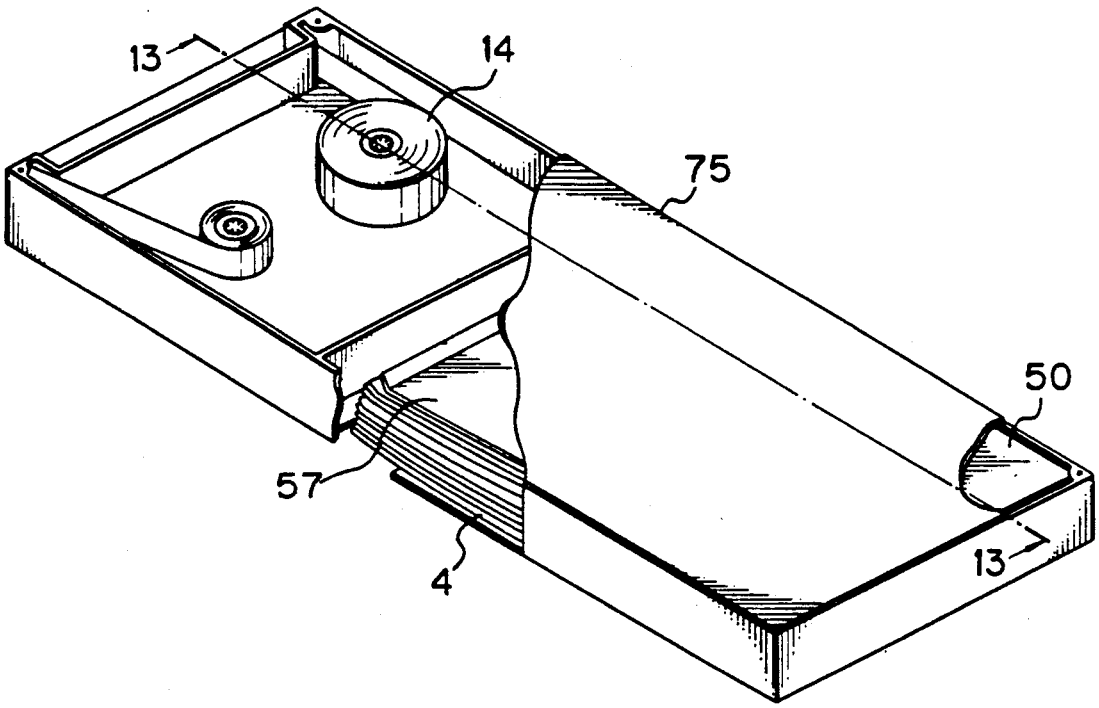
FIG. 12 is a partly cut away perspective view of an expendable cartridge according to a third embodiment of the present invention.
Figure 13:
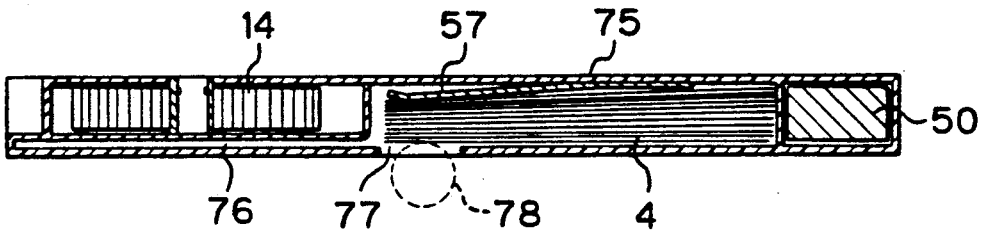
FIG. 13 is a cross sectional view taken along XIII—XIII in FIG. 12.

Third Embodiment (FIGS. 12 and 13)

An expendable cartridge according to a third embodiment will be described with reference to FIGS. 12 and 13.

The expendable cartridge 75 has three chambers housing the thermal ink ribbon 14 stacked printing sheets 4 and the battery 50 respectively. The cartridge 75 has a travelling path 76 under the ink ribbon chamber and the printing sheet chamber has an opening 77. When the expendable cartridge is mounted on the thermal printer body, the printing sheets 4 are fed by the feeding roller 78 disposed under the opening toward the traverlling path 76 one by one.

With such an arrangement, it is possible to reduce the thickness of the expendable cartridge even if the cut sheets are employed by the thermal printer.

It is possible to omit the battery chamber in the expendable cartridge according to the second and the third embodiments of the present invention.

What is claimed is:

1. A thermal printer comprising:

a thermal printer body having carrying means for carrying printing sheets, driving means for driving a narrow ink ribbon, serial-type printing means for carrying out printing on the printing sheets, and control means for controlling the carrying means, the driving means and the printing means; and an expendable cartridge removably attached to the thermal printer body for housing therein a narrow thermal ink ribbon and cut or rolled printing sheets in respective compartments thereof, the thermal ink ribbon being exposed partially and being able to be wound up and let out;

wherein the expendable cartridge is attached to the body so that the carrying means confronts the printing sheets, the printing means confronts an exposed portion of the ink ribbon and is engaged with the ink ribbon driving means.

2. A thermal printer according to claim 1, wherein the thermal printer body comprises:

a lower unit having the carrying means for carrying the printing sheets; and an upper unit, pivotally attached to and openable relative to the lower unit, having the driving means for driving the ink ribbon and the printing means for printing on the printing sheets.

3. A thermal printer according to claim 2, wherein the expendable cartridge is mounted on the lower unit of the thermal printer body.

4. An expendable cartridge assembly for being detachably mounted to a thermal printer body, wherein the thermal printer body comprises a lower unit having carrying means for carrying printing sheets, and an upper unit, pivotally attached to and openable relative to the lower unit, the upper unit having driving means for driving a narrow ink ribbon, printing means for printing on the printing sheets, and control means for controlling the carrying means, driving means and printing means, the expendable cartridge assembly comprising:

a printing sheet cartridge for housing cut printing sheets or a roll printing sheet therein; and an ink ribbon cartridge incorporated integrally with the printing sheet cartridge for housing a narrow ink ribbon of at least one color therein so as to be able to be wound up and let out.

5. An expendable cartridge assembly according to claim 4, wherein the printing sheet cartridge and the ink ribbon cartridge are separable from each other.

6. An expendable cartridge assembly according to claim 4, wherein the ink ribbon cartridge is layered on the printing sheet cartridge.

7. An expendable cartridge assembly according to claim 4, wherein the ink ribbon cartridge is disposed in parallel with the printing sheet cartridge.

* * * * *